US005622191A

United States Patent [19]

McMullen, Jr. et al.

[11] Patent Number: 5,622,191

[45] Date of Patent: Apr. 22, 1997

[54] NAIL CLIPPER

[75] Inventors: Thomas J. McMullen, Jr., Eden Prairie; James Reichow, Minneapolis, both of Minn.

[73] Assignee: Nail Nabber, Inc., Edina, Minn.

[21] Appl. No.: 559,793

[22] Filed: Nov. 15, 1995

[51] Int. Cl.[6] ..... A45D 29/18; B26B 17/00

[52] U.S. Cl. ..... 132/75.5; 132/73; 132/75.4; 30/29

[58] Field of Search ..... 132/73, 75.4, 75.5; 30/28, 29

[56] References Cited

U.S. PATENT DOCUMENTS

| | | | |
|---|---|---|---|
| 2,616,436 | 11/1952 | Langley | 132/75.5 |
| 2,753,626 | 7/1956 | Bowers . | |
| 2,799,923 | 7/1957 | Senshu . | |
| 2,887,773 | 5/1959 | Killen . | |
| 2,970,376 | 2/1961 | Kuo . | |
| 2,999,506 | 9/1961 | Hunt | 132/75.5 |
| 3,013,334 | 12/1961 | Bassett . | |
| 3,031,753 | 5/1962 | Pocoski . | |
| 3,042,047 | 7/1962 | Plaskon . | |
| 3,169,312 | 2/1965 | Fink . | |
| 3,188,737 | 6/1965 | Chase . | |
| 3,189,996 | 6/1965 | Casey, Jr. . | |
| 3,315,354 | 4/1967 | Oates, Jr. . | |
| 3,744,131 | 7/1973 | Manes . | |
| 3,986,257 | 10/1976 | Kiura . | |
| 4,130,937 | 12/1978 | Kim . | |
| 4,614,031 | 9/1986 | Chen . | |
| 4,819,673 | 4/1989 | McMullen, Jr. | 132/75.5 |

FOREIGN PATENT DOCUMENTS 243901 12/1924 United Kingdom .

*Primary Examiner*—Gene Mancene
*Assistant Examiner*—Pedro Philogene
*Attorney, Agent, or Firm*—Patterson & Keough, P.A.

[57] ABSTRACT

A nail clipper designed to trim a portion of the nail of a person's digit without causing injury to the flesh portion of the digit includes a U-shaped body that has a first and second end and includes first and second, spaced-apart handles interconnected by a central arc portion between the handles proximate the first end. The handles are resiliently biased by the central arc portion into a partially extending, normal resting position. The central arc portion serves as a hinge. A first blade is fixedly coupled to the first handle and has a cutting slot defined in the structure thereof. A second blade is operably, pivotally coupled to the first handle and has an actuator for imparting pivotal motion thereto. The actuator is operably coupled to the second handle. The first blade cutting slot and the second blade form a shearing relationship therebetween, whereby a portion of the structure of the first blade is a safety barrier acting to prevent the presentation of the flesh of the digit to the shearing effects of the second blade with respect to the first blade cutting slot.

26 Claims, 2 Drawing Sheets

NAIL CLIPPER

BACKGROUND OF THE INVENTION

1. Field of the Invention

The present invention relates to nail clippers. More particularly, the present invention relates to nail clippers that include a safety shield to prevent injury to the flesh that is proximate the nail being clipped.

2. Description of the Prior Art

Nail clippers are traditionally made of metal, usually steel, and have a complicated structure. Typically, clippers are not ready for immediate use when needed because they must be reconfigured from a storage configuration to a operable configuration.

Further, nail clippers generally lack any safety features. A user may push a nail too far into the device such that flesh located proximate the nail is imposed between the blades. Actuation of the nail clipper then causes a flesh wound. This problem can be especially great when a clipper is used on an infant or on a small child. The finger or toe of the infant and the nail are so small and it is so difficult to see if the tip of the finger or toe is between the blades, yet an infant's nails must be clipped in order to prevent the child from scratching himself. Clipping an infant's nails is an experience of high anxiety for a parent. Some parents resort to trimming an infants nails by biting them out of reluctance to use a conventional nail trimmer and risk injury to the infant.

When either using a clipper on oneself or another, lack of fine motor control can result in injury. A conventional clipper is difficult to use for people without full and free mobility, such as those with arthritis or carpal tunnel syndrome. A substantial force, as well as dexterity and coordination, are often required in order to compress the blades so that the nails can be clipped, which can be difficult and painful for people with hand-related problems. The reduced force and coordination required to operate the invention, coupled with its safety feature, allows children and others to efficiently operate the device.

U.S. Pat. No. 3,986,257 by Kiura discloses a nail clipper which includes a nail repository between the handles of the device. The cutting edges are located at the far end of the device rather than on the side of the device.

U.S. Pat. No. 2,616,436 by Langley discloses a clipper with a pair of side shearing elements located halfway between the hinged end and the opposite end of the handles. The invention does not disclose any safety measures to insure that the tip of the finger or toe is not caught within the shearing means during clipping operation.

U.S. Pat. No. 2,999,506 by Hunt discloses another nail clipper with a side shearing element. This clipper again does not include any safety features to exclude the tip of the digit being clipped.

U.S. Pat. No. 3,315,354 by Oates discloses a combination of two traditionally configured nail clippers one of a larger and one of a smaller size, one to be used for finger nails and the other to be used for cuticles. The shearing element is located at the end rather than the side of the device.

U.S. Pat. No. 4,648,415 discloses another nail clipper with the shearing elements located on the end of the device. That clipper includes a nail clipping repository to conveniently collect the clippings. However, it does not include any safety features.

U.S. Pat. No. 3,189,996 by Casey, Jr., discloses a nail clipper with a protective guard. The protective guard in this invention is only utilized for protection during storage of the device. When the device is arranged for use, the protective guard does nothing to keep the operator from being injured.

U.S. Pat. No. 3,420,047 by Plaskon, discloses a clipper with side shearing means near the hinged end of the clipper, but providing for no safety means.

U.S. Pat. No. 2,043,901 by Willetts, discloses a clipper with the shearing blades located closer to the open ends of the handles distal from the fulcrum point.

U.S. Pat. No. 4,819,673 by McMullen, Jr., discloses a nail clipper with a side shearing device and in one of the embodiments includes a nail repository for severed nails. Another embodiment includes a hinged means, the other includes a malleable material means for causing the clipper handles to resume their original parallel configuration after use.

There is a need for a nail clipper design that is easy and safe to use on infants and small children without the problem of inadvertently cutting the flesh that is proximate the nail that is being cut. Additionally, there is a need for a nail clipper that is easily and safely used by persons that lack the fine motor control that is necessary for the operation of conventional nail clippers and affords the maximum degree of safety with respect to the potential of causing a flesh wound.

SUMMARY OF THE INVENTION

In keeping with the principles of the present invention, the objects are accomplished with the unique combination of an elastic U shaped body including metal cutting elements and safety guard. The combination of those elements in the present invention results in a device which is both simple and safe to use. The device is simple in that the operator need only apply opposing forces on the handles of the clipper in order to create a clipping motion. The handles only rotate relative to one axis rather than two axes of rotation possible in other clipping devices. Further the amount of force required due to choice of material of the handles of the clipper creates a clipper usable by children and handicapped adults. Another object of the invention is to provide a nail clipper which safely severs nails. Safety aspects of the clipper result from the clipping action occurring on nails which are positioned in a groove of a size and shape adequate to only allow the nail itself to pass through rather than the surrounding skin of the nail. This prevents the operator from cutting the flesh surrounding the nail thereby insuring safe use either by the operator on the operator's own nails or by another individual operating the device on a second party.

The nail clipper is designed to trim a portion of the nail of a person's digit without causing injury to the flesh portion of the digit. The nail clipper includes a U-shaped body that has a first and second end and includes first and second, spaced-apart handles interconnected by a central arc portion between said handles proximate the first end. The handles are resiliently biased by said central arc portion into a partially extending, normal resting position. The central arc portion serves as a hinge. A first blade is fixedly coupled to the first handle and has a cutting slot defined in the structure thereof. A second blade is operably, pivotally coupled to the first handle and has an actuator for imparting pivotal motion thereto. The actuator is operably coupled to the second handle. The first blade cutting slot and the second blade form a shearing relationship therebetween, whereby a portion of the structure of the first blade is a safety barrier acting to prevent the presentation of the flesh of the digit to the shearing effects of the second blade with respect to the first blade cutting slot.

BRIEF DESCRIPTION OF THE DRAWINGS

In the accompanying drawings, wherein like numerals of reference refer to similar parts throughout.

DESCRIPTION OF THE PREFERRED EMBODIMENT

Figure 1:
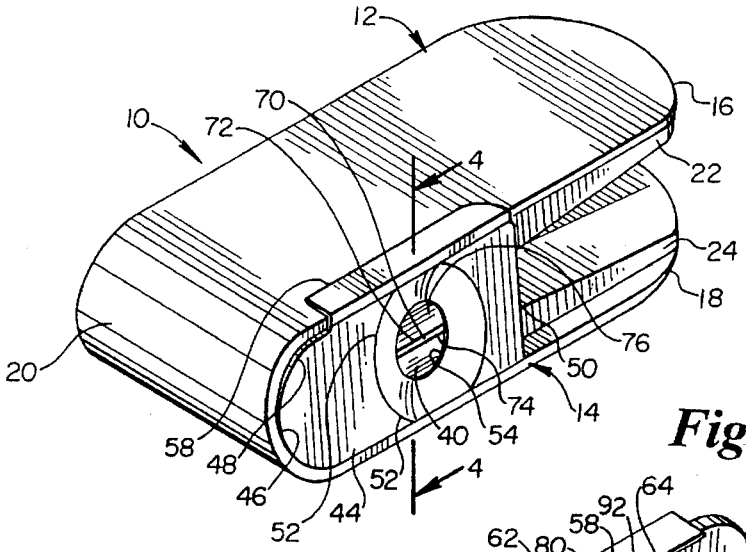
FIG. 1 is a perspective view of a preferred embodiment of the nail clipper of the present invention.
Figure 2:
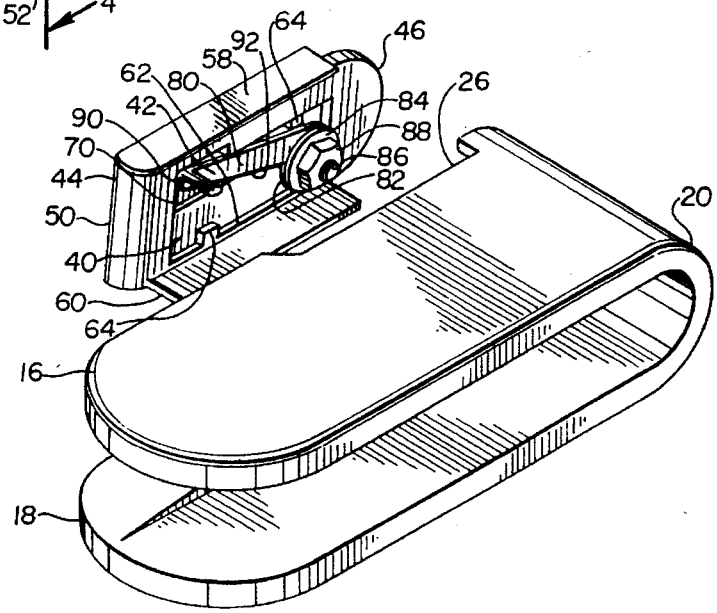
FIG. 2 is a perspective view of the nail clipper with the blade set broken out.

A nail clipper of the present invention is shown generally at 10 in a first preferred embodiment in FIGS. 1–4 and in a second preferred embodiment in FIGS. 5–8. The nail clipper 10 of both preferred embodiments has two major components; the body 12 and the blade set 14.

Referring to FIGS. 1–4, the body 12 of the nail clipper 10 is preferably formed of a continuous piece of plastic material that defines an upper handle 16 and a lower opposed handle 18 joined at a first end thereof by an arc portion 20. The body 12 is preferably made of a suitable plastic material which exhibits good shape memory and fatigue resistance, such that nail clipper 10 repeatedly returns to its relaxed position after numerous compressions of the upper handle 16 and lower handle 18 to effect the trimming of a nail. Additionally, the plastic material should be well suited to injection molding type formation.

The upper handle 16 has a strengthening upper handle rib 22 inwardly disposed along the underside of the upper handle 16. The lower handle 18 has a lower handle rib 24 inwardly disposed along the upper side of the lower handle 18. The ribs 22, 24 taper from the arc portion 20 toward the opposed second end of the body 12.

A tang slot 28 is formed in the upper handle rib 22. The tang slot 28 defines a narrow opening having its long axis generally parallel to the upper surface of the upper handle 16. Tang slot 28 projects into the upper handle rib 22, transverse to the lengthwise axis of the body 12.

Figure 3:
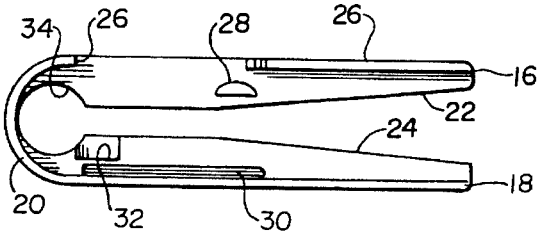
FIG. 3 is a side elevational view of the body of the nail clipper.
Figure 4:
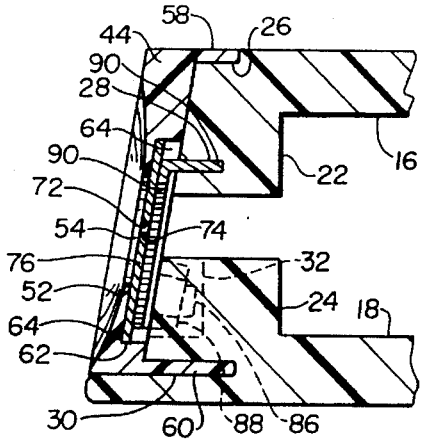
FIG. 4 is a sectional view taken along line 4—4 of FIG. 1.

As depicted in FIGS. 3 and 4, a lower cover slot 30 is defined in the lower handle rib 24. The lower cover slot 30 has a generally rectangular opening, the long axis of which is generally parallel to the lower surface of lower handle 18. The lower cover slot 30 projects into the lower handle rib 24, transverse to the lengthwise axis of the body 12. A generally circular spring relief 34 is defined between the upper handle rib 22, the lower handle rib 24, and the arc portion 20. The spring relief 34 removes structural material proximate the arc portion 20 in order to minimize the force needed to bend the arc portion 20 and to effect trimming of a nail.

The blade set 14 includes a lower fixed blade 40, an upper pivoting blade 42, and a blade cover 44. The lower fixed blade 40 and the upper pivoting blade 42 are aligned to produce a scissors-type interference cut. That is, the blades 40, 42 are not aligned to meet at their respective cutting edges, but rather they interface with each other in a generally flush manner so as to shear off the finger nail.

The blade cover 44 is preferably formed of a smooth plastic material similar to that of the body 12. The blade cover 44 has a first semi-circular end 46. The arc defined at the semi-circular end 46 has a decreasing diameter proximate the upper portion thereof, as depicted in FIG. 1. The decreasing diameter results in a gap 48 being formed between the outer surface of semi-circular end 46 and the inner surface of the arc portion 20. The gap 48 is necessary to accommodate the compression of the arc portion 20 when the upper handle 16 and the lower handle 18 are pressed together to effect the trimming of a nail. The blade cover 44 has a squared end 50 that is opposed to the semi-circular end 46.

A generally circular indent 52 is formed in the outer surface of the blade cover 44 to accommodate the insertion of the flesh portion of a digit therein. The indent 52 gets gradually deeper into the blade cover 44 when moving from its outer circumference to its inner circumference. A generally circular blade opening 54 is defined at the inner circumference of the indent 52. The blade opening 54 extends through the cover 44.

An upper cover extension 58 and a lower cover extension 60 project inward to the right as depicted in FIG. 4, toward the body 12 of the nail clipper 10.

A generally rectangular lower blade receptacle 62 is defined in the inner side of the blade cover 44. A pair of blade retainers 64 project into the space defined by the lower blade receptacle 62. The blade opening 54 carries through the cover 44 and opens into the lower blade receptacle 62.

The lower fixed blade 40 has a generally rectangular shape designed to be held within the lower blade receptacle 62 by the blade retainers 64. The lower fixed blade 40 has a slot 70 defined therein. Slot 70 is preferably oriented generally parallel with the lower surface of the lower handle 18. The length of the slot 70 is preferably at least as great as the diameter of the blade opening 54 and is in registry therewith. The slot 70 has a slot upper edge 72 and a slot cutting edge 74, the slot cutting edge 74 also being the slot lower edge. The outward facing surface of the lower fixed blade 40 defines a safety barrier 76 that keeps the flesh portion of a finger or toe from entering the slot 70 when a nail to be trimmed is positioned in the slot 70.

The slot 70 is preferably positioned proximate the center of the lower fixed blade 40. The outer portions of the lower fixed blade 40 are available to act as the safety barrier 76 to prevent flesh from being caught between the slot cutting edge 74 and the upper pivoting blade 42. Additionally, in the preferred embodiment of FIGS. 1–4, the indent 52 defined in the cover 44 and the surrounding portion of the cover 44 act to further impede the insertion of flesh into the slot 70 where injury may occur.

The upper pivoting blade 42 has a blade arm 80 and a pivot 82. The pivot 82 has a bore (not shown) defined therein. Such bore is placed over a stud 86 in pivotal engagement therewith. The stud 86 is anchored at one end in the blade cover 44. A washer 84 and a nut 88 disposed on the stud 86 secure the upper pivoting blade 42 in place. The stud 86 is oriented generally transverse to the plane of the lower fixed blade 40 so that the pivotal motion of the upper pivoting blade 42 is generally parallel to the plane of the lower fixed blade 40.

An inwardly directed tang 90 is formed at the opposite end of the blade arm 80 from pivot 82. A beveled cutting edge 92 is formed on the underside of the blade arm 80.

In assembly, the blade set 14 is positioned at the side of the body 12 by inserting lower cover extension 60 into the lower cover slot 30 and generating a compression fit therebetween. Once so positioned, the upper cover extension 58 rides loosely within the blade cover cutout 26 and is not affixed thereto. Simultaneously, the tang 90 of the upper pivoting blade 42 is inserted within the tang slot 28. The upper pivoting blade 42 is then pivotally coupled to the lower handle 18 and the pivoting action thereof is actuated by the upper handle 16.

To use the nail clipper 10 disclosed in FIGS. 1–4, the nail to be trimmed is advanced into the slot 70 of the lower fixed blade 40. The portion of the nail that is to be trimmed projects inward from the inward side of the lower fixed blade 40. The flesh portion of the finger or toe bearing the nail will abut the safety bearer 76 and the indent 52 of the cover 44 and not project into the slot 70. The person utilizing the nail clipper 10 then compresses the upper handle 16 and lower handle 18 together. By means of the upper handle 16 being in engagement with the tang 90 of the upper pivoting blade 42, such compression forces the cutting edge 92 of the upper pivoting blade 42 to shear across the slot cutting edge 74. The cutting action commences from left and progresses to the right of the slot cutting edge 74, as depicted in FIG. 1, as the upper pivoting blade 42 is pivoted downward. Such action trims the portion of the nail that is projecting inward from the inner side of the slot cutting edge 74 by a shearing, scissor's-like action.

A second preferred embodiment of the nail clipper 10 of present invention is depicted in FIGS. 5–8, wherein like numbers refer to similar parts as depicted in FIGS. 1–4. The nail clipper 10 has components body 12 and blade set 14.

The body 12 has an upper handle 16, a lower handle 18, and an arc portion 20. The body 12 is preferably made of a plastic material as described with reference to the aforementioned first preferred embodiment. A non slip pad 100 is adhesively bonded to the upper surface of the upper handle 16 and a corresponding pad (not shown) is bonded to the lower surface of the lower handle 18 to aid the user in gripping the nail clipper 10.

A tang slot 28 and a blade guide relief 102 are formed in the upper handle 16. The blade guide relief 102 is downward facing having an opening projecting downward and a roof portion 103 overlying the blade guide relief 102. A blade retaining slot 104 is formed in the edge of the lower handle 18.

The blade set 14 is comprised of a lower fixed blade 40 and an upper pivoting blade 42. The lower fixed blade 40 is generally rectangular in shape. A blade support portion 105 of the lower fixed blade 40 is disposed within the blade retaining slot 104 and held therein by self tapping screws 108. The upper portion of the lower fixed blade 40 has an inwardly directed, generally right angle bend 106.

The lower fixed blade 40 has a slot 70 defined therein. The slot 70 is an elongate narrow slot designed to receive the nail to be trimmed therethrough. Slot 70 has a slot upper edge 72 and a slot cutting edge 74. The slot cutting edge 74 also comprises the slot lower edge.

A finger indent 114 is formed in the exterior surface of the lower fixed blade 40. The finger indent defines a curvature designed to generally adapt to the curvature of the flesh portion of a persons fingertip. The entire exterior surface of the lower fixed blade 40, including the finger indent 114, comprises a safety bearer 76 designed to prevent the insertion of any flesh portion of a persons finger into the slot 70, where a cutting injury may occur.

The lower affixed blade 40 has a bore (not shown) defined therein. A pivot bolt 110 is disposed within the bore.

In a preferred embodiment, the slot cutting edge 74 of the lower fixed blade 40 is defined at the inward edge of an anvil 112. The anvil 112 is an inwardly directed projection that projects inwardly from inside surface of the lower fixed blade 40, extending the slot cutting edge 74. The anvil 112 provides structure across which the shearing action of the upper pivoting blade 42 is directed.

The upper pivoting blade 42 has a blade arm 80 and a pivot 82. The pivot 82 has a bore (not shown) defined therein. The bore of the pivot 82 is fitted over the pivot bolt 110 and the nut 88 is threadingly engaged therewith, holding the upper pivoting blade 42 in close shearing engagement with the lower fixed blade 40. The pivot bolt 110 is oriented generally transverse to the plane of the lower fixed blade 40 so that the pivotal motion of the upper pivoting blade 42 is generally parallel to the plane of the lower fixed blade 40.

A bevelled cutting edge 92 is formed on the lower margin of the upper pivoting blade 42. An inwardly directed tang 90 is defined at the opposite end of the blade arm 80 from the pivot 82.

In assembly, the lower fixed blade 40 is affixed to lower handle 18 by the means of screws 108. Simultaneously, the tang 90 of the upper pivoting blade 42 is inserted into the tang slot 28. The upper pivoting blade 42 is then pivotally coupled to the lower fixed blade 40, which is in turn fixedly coupled to the lower handle 18, and is actuated by the upper handle 16.

Figure 7:
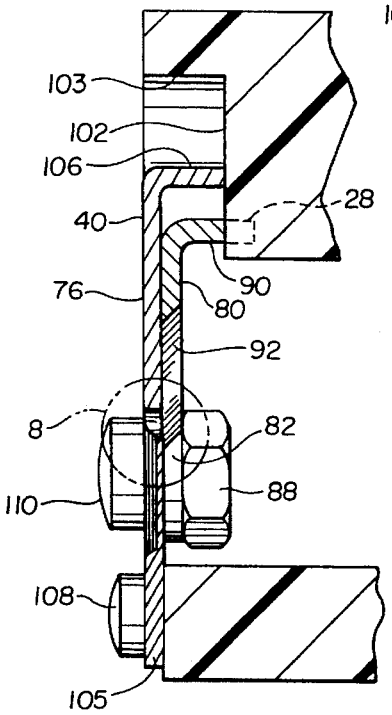
FIG. 7 is a sectional view thereof taken along line 7—7 of FIG. 6.
Figure 8:
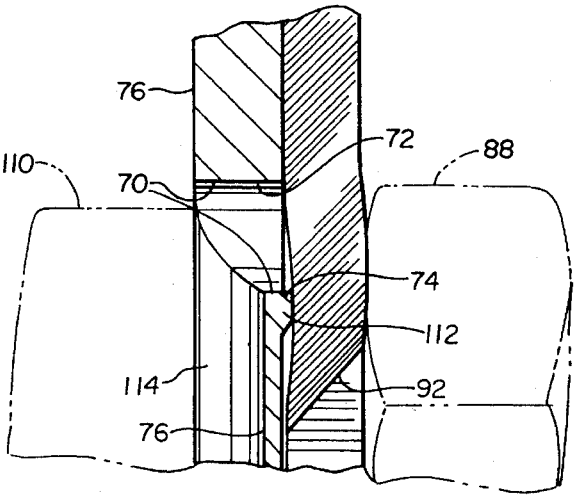
FIG. 8 is a sectional view of the nail clipper taken from the circular notation 8 of FIG. 7.

To trim a nail, the person inserts the nail into slot 70 until the portion of the nail to be trimmed projects inward of the slot cutting edge 74. The flesh part of the tip of the finger or toe will abut the safety bearer 76 and thereby be prevented from entering the slot 70. It is preferable that the nail be presented to the slot 70 in an orientation that is substantially transverse to the plane of the lower fixed blade 40. In this manner, a sufficient portion of the nail will project through the slot 70 and project inward of the slot cutting edge 74 to be trimmed without presenting any flesh to the cutting action of the blades 40, 42. However, if the finger approaches the slot 70 with an orientation that is from above, a much greater portion of the nail may be inserted through the slot 70 and the resulting cut will trim the nail painfully close to the flesh or may actually cut the flesh. To guard against this occurring, the height "h" of the slot 70, as depicted in FIG. 1 and the width "w" of the lower fixed blade 40, as depicted in FIG. 7 must be selected to present a slot 70 that is suitably sized to be able to readily project a nail therethrough and at the same time have a sufficient distance from where the flesh portion of the finger abuts the lower fixed blade 40 to the slot cutting edge 74 that the possibility of presenting flesh to the slot cutting edge 74 is minimized. The dimensions "h" and "w" also must be tailored for the size nail that is intended to be trimmed. Accordingly, the dimensions "h" and "w" for a nail clipper 10 that is intended to be used for adult sized nails is different from the dimensions "h" and "w" for a nail clipper 10 that is intended to be used for infant sized nails. It has been determined that for infant sized nails the dimension "h" should be between 0.015 and 0.025 inch when the dimension "w" is between 0.010 and 0.025 inch. Preferably, such dimensions will both be 0.020 inch.

Figure 5:
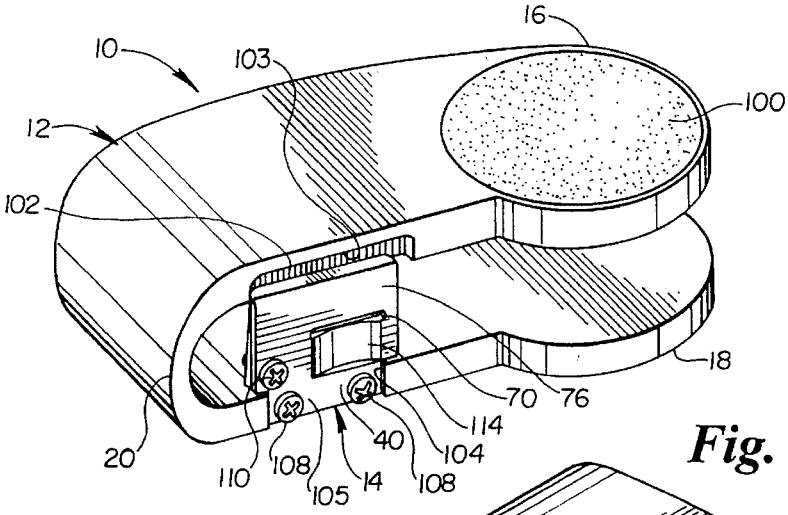
FIG. 5 is a perspective view of a second preferred embodiment of the nail clipper of the present invention.
Figure 6:
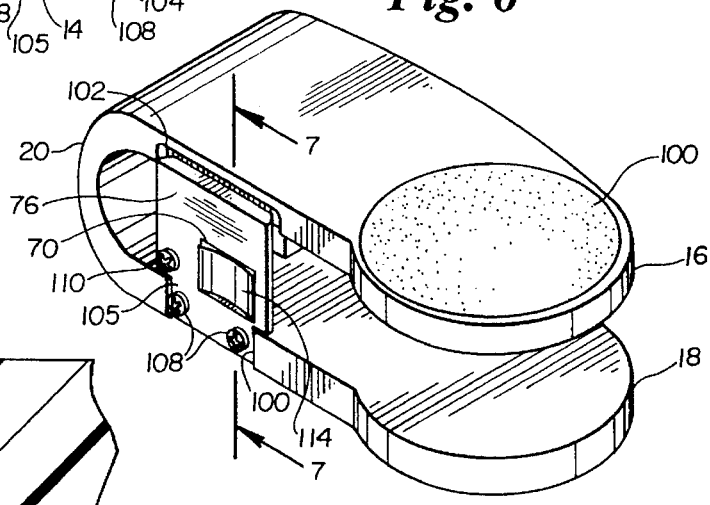
FIG. 6 is a perspective view of the nail clipper.

After insertion of the nail into the slot 70, the person compresses the upper handle 16 and lower handle 18 together. The beveled cutting edge 92 of the upper pivoting blade shears across the slot cutting edge 74 of the lower fixed blade 40. This action progressively trims the nail that projects inward beyond the anvil 112 starting from left to right, as depicted in FIG. 5, by scissors-like shearing action. As the upper handle 16 is depressed, the bend 106 of the lower fixed blade 140 ultimately comes in contact with the roof portion 103 of the blade guide relief 102, thereby acting as a stop and preventing over travel of the upper handle 16 with respect to the lower handle 18.

It is understood that a number of modifications can be readily devised in accordance with the principles of the present invention by those skilled in the art without departing from the spirit and scope of the invention. Therefore, it is not desired to restrict the invention to the particular constructions illustrated and described, but to cover all modifications that may fall within the scope of the appended claims.

We claim:

1. An improved nail clipper for trimming a nail disposed on a digit of a person, comprising a U-shaped body having a first and a second end, including first and second, spaced-apart longitudinal handles interconnected by a central arc portion between said handles proximate said first end, said handles being resiliently biased by said central arc portion into a partially extending, normal resting position whereby said central arc portion serves as a hinge means; and first and second blades, said blades being disposed in a facing relationship, the improvement comprising:

the first blade fixedly coupled to the first handle and having a cutting slot defined in the structure thereof; and the second blade being operably pivotally coupled to the first handle, having actuation means for imparting pivotal motion thereto being operably coupled to the second handle, the first blade cutting slot and the second blade forming a shearing relationship therebetween, whereby a portion of the structure of the first blade presents a safety barrier acting to prevent the presentation of the flesh of the digit to the shearing effects of the first blade with respect to the second blade.

2. An improved nail clipper as claimed in claim 1 wherein the first blade presents a first inwardly directed face and a second opposed outwardly directed face, the cutting slot thereof extending through the structure of the first blade from the first face to the second face, and the second blade being disposed proximate the first face of the second blade, whereby the pivotal motion of the second blade defines a path that is generally parallel to the first face of the first blade.

3. An improved nail clipper as claimed in claim 2 wherein the nail to be trimmed is advanced into the cutting slot from the outwardly directed second face of the first blade and the portion of the nail to be trimmed projects through the cutting slot and inward of the first inwardly directed face of the first blade.

4. An improved nail clipper as claimed in claim 3 wherein the cutting slot is an elongate aperture having two opposed and spaced apart surfaces, a selected one of said surfaces being a cutting surface and forming a shearing relationship with the second blade.

5. An improved nail clipper as claimed in claim 3 wherein the cutting slot elongate aperture has a heighth dimension of between 0.015 and 0.025 inch and the width dimension of the first blade from the second opposed outwardly directed face to the cutting surface thereof is between 0.010 and 0.025 inch.

6. An improved nail clipper as claimed in claim 3 wherein the cutting slot elongate aperture has a heighth dimension of 0.020 inch and the width dimension of the first blade from the second opposed outwardly directed face to the cutting surface thereof is 0.020 inch.

7. An improved nail clipper as claimed in claim 4 further including an anvil formed integral with the cutting surface of the cutting slot and projecting inward from the first face of the first blade to define an extension of the cutting surface and forming a shearing relationship with the second blade.

8. An improved nail clipper as claimed in claim 2 further including cover means disposed proximate the second face of the first blade and being coextensive with a portion thereof and having an aperture defined therein, a portion of said aperture being in registry with the cutting slot, whereby the cover means and the second face of the first blade cooperatively present a safety barrier to the flesh portion of the digit of a person.

9. An improved nail clipper according to claim 1, wherein said handles and central arc portion are formed of plastic and said first and second blades are formed of metal.

10. An improved nail clipper according to claim 1, wherein said slot is disposed proximate the center portion of the first blade.

11. An improved nail clipper according to claim 9, wherein said plastic has inherent memory.

12. An improved nail clipper according to claim 11, wherein said plastic has inherent fatigue resistance.

13. An improved nail clipper according to claim 1, wherein the length of one side of each of the handles is curved outward to define a handle gripping surface.

14. An improved nail clipper designed to trim a portion of the nail of a person's digit without causing injury to the flesh portion of the digit, comprising;

a U-shaped body having a first and second end and including first and second, spaced-apart handles interconnected by a central arc portion between said handles proximate said first end, said handles being resiliently biased by said central arc portion into a partially extending, normal resting position, said central arc portion serving as a hinge means;

a first blade fixedly coupled to the first handle and having a cutting slot defined in the structure thereof; and a second blade being operably pivotally coupled to the first handle, having actuation means for imparting pivotal motion thereto being operably coupled to the second handle, the first blade cutting slot and the second blade forming a shearing relationship therebetween, whereby a portion of the structure of the first blade presents a safety barrier acting to prevent the presentation of the flesh of the digit to the shearing effects of the second blade with respect to the first blade cutting slot.

15. An improved nail clipper as claimed in claim 14 wherein the first blade presents a first inwardly directed face and a second opposed outwardly directed face, the cutting slot thereof extending through the structure of the first blade from the first face to the second face, and the second blade being disposed proximate the first face of the second blade, whereby the pivotal motion of the second blade defines a path that is generally parallel to the first face of the first blade.

16. An improved nail clipper as claimed in claim 15 wherein the nail to be trimmed is advanced into the cutting slot from the outwardly directed second face of the first blade and the portion of the nail to be trimmed projects through the cutting slot and inward of the first inwardly directed face of the first blade.

17. An improved nail clipper as claimed in claim 16 wherein the cutting slot is an elongate aperture having two opposed and spaced apart surfaces, a selected one of said surfaces being a cutting surface and forming a shearing relationship with the second blade.

18. An improved nail clipper as claimed in claim 17 further including an anvil formed integral with the cutting surface of the cutting slot and projecting inward from the first face of the first blade to define an extension of the cutting surface and forming a shearing relationship with the second blade.

19. An improved nail clipper as claimed in claim 17 further including cover means disposed proximate the second face of the first blade and being coextensive with a portion thereof and having an aperture defined therein, a portion of said aperture being in registry with the cutting slot, whereby the cover means and the second face of the first blade cooperatively present a safety barrier to the flesh portion of the digit of a person.

20. An improved nail clipper according to claim 14, wherein said handles and central arc portion are formed of plastic and said first and second blades are formed of metal.

21. An improved nail clipper according to claim 14, wherein said slot is disposed proximate the center portion of the first blade.

22. An improved nail clipper according to claim 20, wherein said plastic has inherent memory.

23. An improved nail clipper according to claim 22, wherein said plastic has inherent fatigue resistance.

24. An improved nail clipper according to claim 14, wherein the length of one side of each of the handles is curved outward to define a handle gripping surface.

25. An improved nail clipper as claimed in claim 14 wherein the cutting slot the elongate aperture has a heighth dimension of between 0.015 and 0.025 inch and the width dimension of the first blade from the second opposed outwardly directed face to the cutting surface thereof is between 0.010 and 0.025 inch.

26. An improved nail clipper as claimed in claim 14 wherein the cutting slot elongate aperture has a heighth dimension of 0.020 inch and the width dimension of the first blade from the second opposed outwardly directed face to the cutting surface thereof is 0.020 inch.

* * * * *